US010438457B2

(12) United States Patent
Kramer et al.

(10) Patent No.: US 10,438,457 B2
(45) Date of Patent: Oct. 8, 2019

(54) SYSTEM AND METHOD TO REMOTELY DETECT ALARMS

(71) Applicant: BlueRadios, Inc., Englewood, CO (US)

(72) Inventors: Mark Kramer, Castle Rock, CO (US); Wilfred Tucker, Centennial, CO (US); Timothy Ikenouye, Denver, CO (US)

(73) Assignee: BlueRadios, Inc., Englewood, CO (US)

( * ) Notice: Subject to any disclaimer, the term of this patent is extended or adjusted under 35 U.S.C. 154(b) by 0 days.

(21) Appl. No.: 14/867,398

(22) Filed: Sep. 28, 2015

(65) Prior Publication Data

US 2016/0093202 A1 Mar. 31, 2016

Related U.S. Application Data

(60) Provisional application No. 62/056,956, filed on Sep. 29, 2014.

(51) Int. Cl.
*G08B 1/08* (2006.01)

(52) U.S. Cl.
CPC ..... *G08B 1/08* (2013.01)

(58) Field of Classification Search
CPC ... G08B 1/00; G08B 1/08; G08B 3/10; G08B 5/00; G08B 29/00; H04Q 1/08
USPC ..... 340/506, 531, 539, 541, 539.1, 539.16, 340/539.17, 539.18, 517
See application file for complete search history.

(56) References Cited

U.S. PATENT DOCUMENTS 6,215,404 B1 * 4/2001 Morales ..... G08B 13/19656 340/531
8,289,157 B2 10/2012 Patenaude et al.
2002/0030871 A1 * 3/2002 Anderson ..... H04B 1/385 398/132
2009/0286514 A1 * 11/2009 Lichorowic ..... H04M 3/4938 455/412.2
2011/0133933 A1 * 6/2011 Davis ..... G08B 13/1436 340/571
2011/0273284 A1 * 11/2011 Jones ..... G08B 25/009 340/533
2015/0072613 A1 * 3/2015 Swanson ..... H04W 88/04 455/11.1
2015/0097961 A1 * 4/2015 Ure ..... G08B 5/223 348/159
2015/0106020 A1 * 4/2015 Chung ..... G06F 19/3418 702/19

* cited by examiner

*Primary Examiner* — Steven Lim
*Assistant Examiner* — Mancil Littlejohn, Jr.
(74) *Attorney, Agent, or Firm* — Gearhart Law, LLC.

(57) ABSTRACT

A system and method for detecting the activation of at least one alarm has at least one alarm detection device, at least one alarm, and a cloud storage platform. The alarm detection device can monitor and analyze the tonal and/or vibrational qualities of a sound to determine its origin. If the sound is determined to be a warning alarm (i.e. home security system), the information associated with that detection is forward to a gateway which then forwards an alert to an end user. The alarm detection system and methodology can be used with existing alarm systems (retrofit) with little added cost to the consumer. This creates a simple and affordable monitoring solution use in residential, commercial, and industrial settings.

18 Claims, 4 Drawing Sheets

SYSTEM AND METHOD TO REMOTELY DETECT ALARMS

CLAIM OF PRIORITY

This application claims priority to U.S. Application 62/056,956 filed on Sep. 29, 2014, the contents of which are fully incorporated herein by reference in its entirety.

FIELD OF THE EMBODIMENTS

The field of the invention and its embodiments relate to systems and methods of detecting an active state of an alarm. In particular, the present invention and its embodiments relate to an alarm detection device that can be removably positioned near an existing alarm and wirelessly monitor that alarm and transmit information associated with the alarm to any number of users and locations.

BACKGROUND OF THE EMBODIMENTS

Emergency situations call for fast acting responses and notifications of a potential adverse or emergency scenario. There are a number of systems that have an audible warning device (i.e. an alarm) that emits a loud, continuous or intermittent noise upon activation. Typically, such alarms can alert to the presence of smoke, carbon monoxide and other hazardous substances, home intruders, and a number of other potentially deadly conditions.

Carbon monoxide typically results in upwards of 200 deaths per year and places many thousands more in the hospitals each year. Fires, in the home or office, kill thousands annually and injure many thousands more, as well as causing substantive damage to property. As such, the importance of proper alarm system are paramount in these life threatening conditions and are often required to be placed in a structure to adhere with local laws and ordinances.

There are, however, a number of shortcomings associated with the above alarms and other audible alarm systems. For example, an audible alarm may not alert someone who is deaf or hard of hearing to one of the aforementioned conditions. Typically, home alarm-based systems do not have any type of visual indicator, such as a flashing light, that would further alert such people to a dangerous condition.

Additionally, a structure with a particular alarm set-up may have no individuals in the dwelling at the time of the emergency. Depending on the type of alarm system, the alarm system may or may not contact the authorities or other responsive personal upon activation. Thus, the emergency condition could go unnoticed for some duration of time thereby resulting in substantial property damage or loss.

In other instances, an alarm may go off when some individuals are at a structure, such as a home, and others are not present at that location. If there is an emergency, those outside the home may not know and will have no way to verify the safety of those present in the home without an adequate warning to a potentially deadly condition.

Thus, there is need for a system that can alert anyone to the presence of the activation of an alarm thereby alerting them to a potentially deadly condition. This system can act wirelessly and monitor the home or other structure and send notifications, alerts, and the like regarding the operative state of any number of alarms present in or outside the structure. Further, such a system should be able to be retrofit to any existing system thereby providing a cheap and simple solution to the above shortcomings. The present invention and its embodiments meets and exceeds these objectives.

REVIEW OF RELATED TECHNOLOGY

U.S. Pat. No. 8,289,157 pertains to an audio warning monitoring device, system and method including an audio detector, one or more audio screens to determine if monitored sound is an alarm, a processor or logic device to potentially analyze sound data and then instruct a transmitter to send a message with the monitoring device identification and signals representing sound detected by the audio detector to a server. The computer server analyzes the message and authenticates the audio detector, looks up user data associated with the detector, and contacts a user from previously stored user data in order to notify of the alert and then relay the audio signals in an audio file. At the user's option, the server may contact a staffed or automated monitoring center. Here a human operator may listen to the signals in the audio file and take appropriate action, such as calling the location of the alarm for verification or contacting a professional first responder(s).

U.S. Pat. No. 6,215,404 pertains to a network audio-link alarm monitoring system for sensing the sound from triggered alarms and reporting to alarm authorities. The system and method of the invention relies on the aural sound produced from alarms that have been triggered. The system, implemented on a PC or other processor on premises, differentiates the sound coming from different alarms, characterizes the sound as from a particular alarm via FFT processing and reports the alarm over the Internet, public switched telephone, or other communication link to a central station which then reports the alarm to the alarm authority. In another embodiment, the reporting of the alarm is done directly by the PC at the residence or business to the alarm authority over the Internet or other communication link.

Various devices are known in the art. However, their structure and means of operation are substantially different from the present disclosure. The other inventions also fail to solve all the problems taught by the present disclosure. The present invention and its embodiments provide a quick and affordable solution to enable an individual to monitor an alarm from anywhere thereby alerting them to the presence of an active alarm or various other conditions. At least one embodiment of this invention is presented in the drawings below and will be described in more detail herein.

SUMMARY OF THE EMBODIMENTS

A system for alerting a remote location of a change in an operative state of an alarm is described and taught, the system having at least one alarm capable of emitting at least one sound; at least one alarm detection device, wherein the alarm detection device has a housing and is capable of being removably mounted within a proximity to the at least one alarm, and wherein the alarm detection device has at least an accelerometer, a wireless transceiver, a sound collection device, and a processor; at least one wireless gateway operably coupled to the wireless transceiver, wherein the wireless gateway receives at least one first signal from the wireless transceiver and transmits at least one second signal to at least one of a network based remote server, electronic page, or at least one of a plurality of users.

The alarm detection device is preferably located within a predetermined proximity to an alarm of an existing alarm system. Such alarm systems could be a building security system, a fire detection system, a hazardous substance system, or any combination thereof. The alarm detection device may further have at least one depressible button, a light source, or any combination thereof.

The sound collection device, preferably a microphone, captures noise (sound waves) present in the monitoring environment. The accelerometer, preferably a three-axis digital accelerometer, may register vibrations from an environment. In some embodiments, to ascertain whether any of the one or more alarms in the monitoring environment have been activated, the microphone registers a sound associated with an alarm which causes the accelerometer to activate and register any associated vibrations. In other embodiments, the accelerometer first registers vibrations and the microphone is subsequently activated to determine if an alarm can be "heard" by the device. The foregoing enables the device to, in some embodiments, use a multi-layer methodology to properly alert one to the presence of an alarm while limiting or preventing "false positives."

In order to further prevent or limit "false positives" the microprocessor can filter the vibrations and analyze the received vibrations in order to differentiate between a triggered alarm and "background noise." The processor then makes a decision as to whether there has been a triggering of an alarm and upon such a determination may send at least one first signal to a wireless gateway where that signal may then be forwarded to any number of electronic devices. The signal contains a data packet that includes at least information on the alarm triggered and the date/time of the activation of the alarm to be stored and logged by the system.

In another aspect of the invention there is a method of remotely detecting a change in an operative state of at least one alarm, the method having the steps of securing at least one alarm detection device within a proximity to the at least one alarm; the at least one alarm detection device continually monitoring an environment for an aural event, wherein if an aural event is registered then the alarm detection device analyzes the aural event to determine its origin; the at least one alarm detection device sending a first signal upon an authentication of an origin of the aural event, wherein the first signal is transmitted to a wireless gateway; the wireless gateway receiving and interpreting the first signal, wherein the wireless gateway logs a date and time of the signal, the at least one alarm corresponding to the aural event, and the operative state of the at least one alarm; and the wireless gateway sending a second signal to at least one of a remote server or at least one user, wherein the at least one user receives an audio, visual, or audiovisual alert on an electronic device that identifies the at least one alarm. In some instances, the at least one user may be able to take an action in response to the alert notification.

In general, the present invention succeeds in conferring the following, and others not mentioned, benefits and objectives.

It is an object of the present invention to provide a system that can be retrofit to existing alarm containing systems.

It is an object of the present invention to provide a system that is inexpensive and affordable.

It is an object of the present invention to provide a system that can alert any person in any location to the activation of an alarm in an alarm system.

It is an object of the present invention to provide a system that sends a notification or alert to an electronic device.

It is another object of the present invention to provide a system that prevents or limits false positive alerts/notifications.

It is another object of the present invention to provide a system that stores logs detailing the operative state or change thereof of an alarm.

It is another object of the present invention to provide a system that uses tonal and vibrational qualities of a triggered alarm to verify the identity of the alarm.

It is yet another object of the present invention to provide a system that aids in alerting to the presence of a potentially deadly scenario or environment.

DESCRIPTION OF THE PREFERRED EMBODIMENTS

Figure 1:
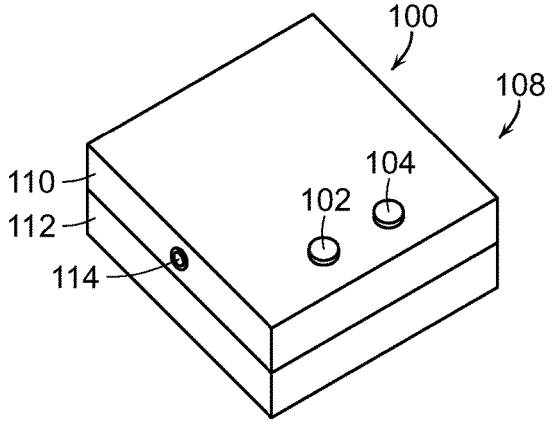
FIG. 1 is a perspective view of an alarm detection device of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, there is a perspective view of an alarm detection device 100 in accordance with an embodiment of the present invention. Some of the external features of the alarm detection device 100 are shown. There may generally be a housing 108 having an upper half 110 and a lower half 112. The upper half 110 is coupled to the lower half 112 forming a chamber therein. The chamber holds and/or retains the circuitry and internal components of the alarm detection device 100. The upper half 110 and the lower half 112 need not be the same size and may be of varying dimensions. In other embodiments, the housing 108 may be a single piece having an access point to access the interior of the housing 108. In other embodiments, the housing 108 may be comprised of more than simply an upper half and a lower half and may take the form of varying shapes and sizes.

The alarm detection device 100 may have at least one depressible button 102 and/or at least one light source 104 such as a light emitting diode (LED) or any combination thereof. The depressible button(s) 102 can have a variety of functionality including to facilitate wireless pairing, to reset/recalibrate the device, mode selection, operative state (on/off) selection, and the like or any combination thereof. In some embodiments, multiple depressible buttons 102 may be required for each desired functionality. Further, there is a sound collection port 114 along at least one side or combination of sides of the housing 108. The sound collection port 114 provides an avenue for sound waves to readily penetrate the housing 108 without being distorted.

Figure 2:
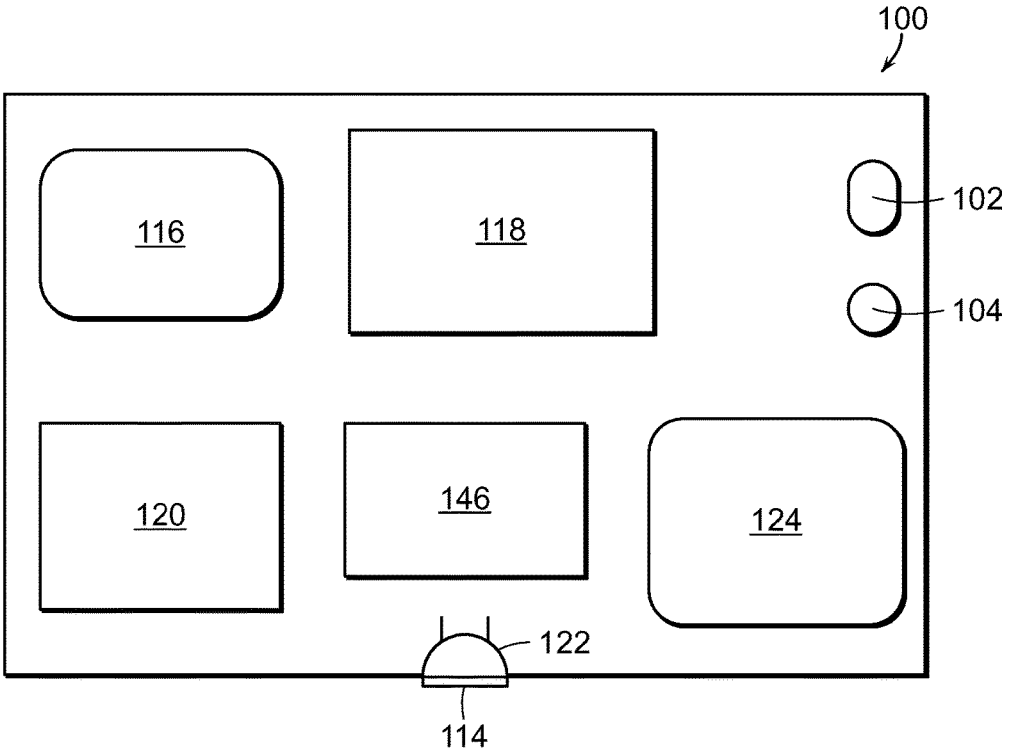
FIG. 2 is schematical overview of the components of an alarm detection device of the present invention.

In FIG. 2, there is a representation of a preferable configuration of an alarm detection device 100. Inside the housing 108 (see FIG. 1) there are a number of internal components. The power source 116, preferably a battery (either solid state or rechargeable), powers the device. A microprocessor 120, accelerometer 118, temperature sensor 146, and a sound collection device 122, preferably a microphone, are all operably coupled to one another and used to capture and analyze information relating to the environment.

The sound collection device 122 readily collects the audible tones associated with an activated alarm as well as other environmental noise. The accelerometer 118 collects vibrations associated with sound waves generated by both activated alarms and general environmental noise. The microprocessor 120 receives and interprets the information collected from both the accelerometer 118 and the sound collection device 122. By analyzing the collected information for various qualities (i.e. decibel level, vibrational pattern, etc.) it can be determined whether an alarm has been triggered.

Further, certain variables such as the decibel level can be customized to a particular peak decibel. As such, a registered decibel would have to cross this threshold before a response would be generated by the alarm detection device. If such a determination is made, the wireless transceiver module 124 may send a first signal to a wireless gateway alerting to the change in operative state of the alarm. In some instances, this sending of a signal is unscheduled (i.e. activation of an alarm). In other instances, the sending of the signal could be scheduled daily, weekly, etc. for the purposes of updating a user on the operative status such as battery level and the like of the alarm detection device 100. Such an "update" notification would be different than a notification if an alarm was detected as not to cause panic in the person(s) receiving the notification.

The temperature sensor 146 may be configurable and can be used as another layer in determining if a fire alarm has been activated. For example, if a signal generated by the accelerometer 118 or sound collecting device 122 is inconclusive, the temperature sensor 146 may be able to indicate an abnormal rise in temperature allowing the processor 120 to send the necessary signal(s). Alternatively, in the event a fire detection system installed in a location fails, the temperature sensor 146 can still register the abnormal rise in temperature causing a signal to be sent by the alarm detection device 100.

Figure 3:
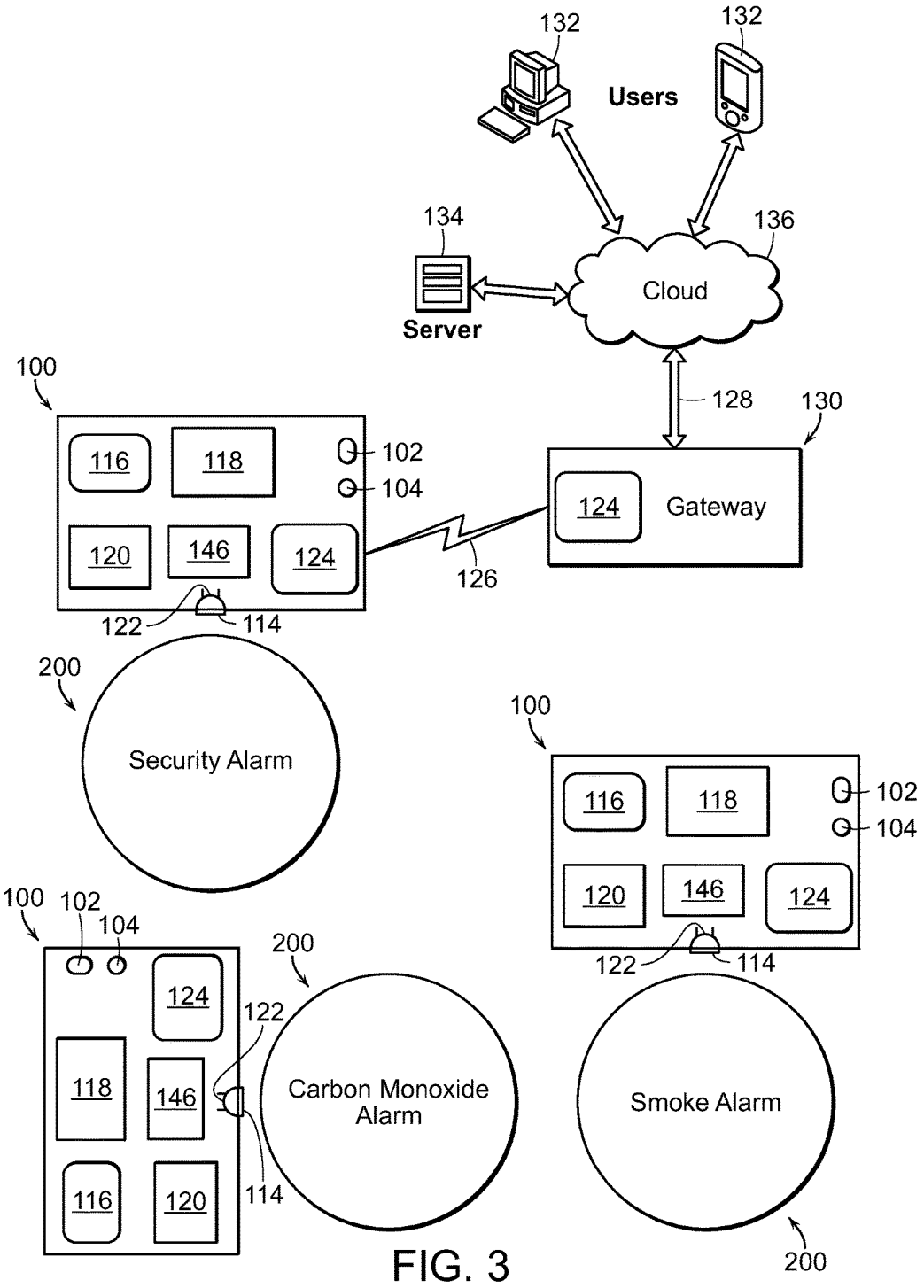
FIG. 3 is a diagram overviewing the alarm detection system as a whole.

Referring now to FIG. 3, there is a graphical representation of a system set up for monitoring a number of alarm types which may be present in a single building or be located in multiple remote areas.

The alarm detection devices 100 have been positioned within a proximity to an alarm 200. The alarm detection device 100 may be removably adhered to the wall or similar structure using a variety of methods including tapes, glues, epoxies, screws, nails, pins, tacks, and the like or any combination thereof. The sound collection port 114 has been oriented to face towards the alarm 200, however, this positioning is not necessary and other orientations may be more appropriate. Further, the accelerometer 118 can generate a response to the movement or displacement (i.e. angular rotation) of an alarm detection device. For example, if someone were to attempt to move the alarm detection device 100 or otherwise tamper with the device, a signal (notification) could be generated and subsequently forwarded to at least one user and stored. In such an event, the microprocessor 120 may be able to recognize such a signature of movement or tampering and send a particularly tailored notification to at least one user.

Figure 4:
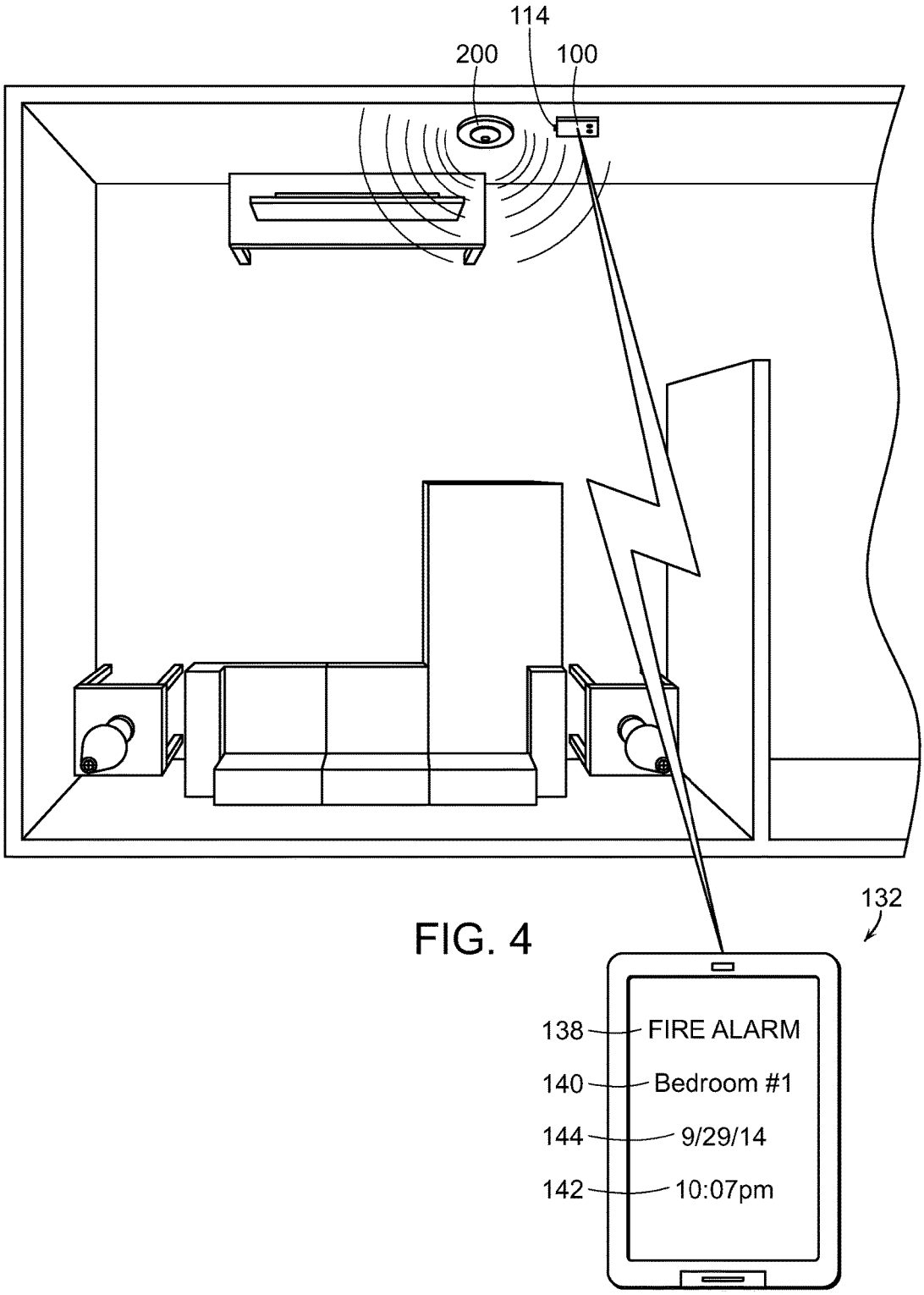
FIG. 4 is a diagram showing the alarm detection device in one intended usage.

As shown in FIG. 4, upon activation of the alarm 200, the alarm detection device 100 may send at least one wireless signal which, in turn, causes a notification 138 to appear on an electronic device 132, in this case a smartphone. The notification 138 may have a number of identifying characteristics pertaining to the alarm detection device 100 such as the location 140, time 142, and date 144 of the activated alarm 200. An audible warning such as a verbal phrase or warning type sound may accompany the notification 138 to instantly alert the user to the notification 138.

The location 140 can be identified in a number of ways including by a particular building, room, coordinates, floor, and the like or any combination thereof. The time 142 may be displayed as the time the alarm detection device 100 was activated by the alarm 200. The date 144 may be the particular date (i.e. day/month/year) of the activation of the alarm 200. In addition to the information sent and received in the notification and as noted above, the information is also sent for cloud storage and potentially to other remote servers. In some embodiments, the signal is automatically sent to the proper authorities (e.g. firehouse).

There may be any number of alarm detection devices 100 within a given structure and each may be positioned in proximity to the same or different alarm system. In some instances, only one alarm detection device 100 may be needed for a particular alarm system. For example, the activation of one fire alarm typically results in the activation of all fire alarms for a given premises.

Figure 5:
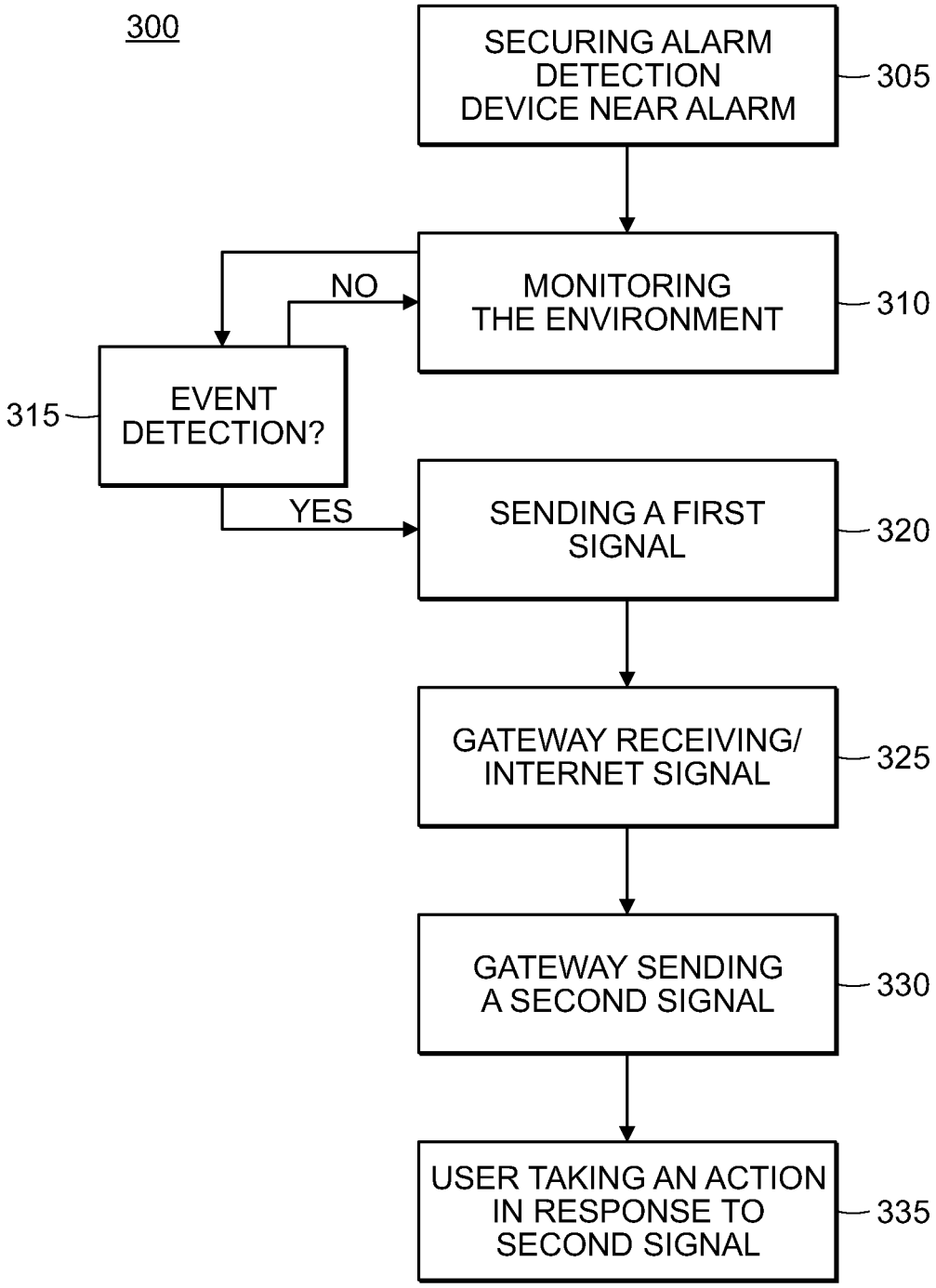
FIG. 5 is a flow chart illustrating a method of using the present invention.

Referring now to FIG. 5, there is a method 300 describing a usage of the system described herein.

In step 305, an alarm detection device is secured within a proximity to at least one alarm. Preferably, this predetermined distance or proximity is about 1 m (39 inch) or less and is more preferably about 13 cm (5 inch) or less. The alarm may be any type of alarm that creates a warning in response to an external stimulus. Typically, this is an alarm that produces an audible warning or sound to alert individuals to the presence of a potentially hazardous condition. In some instances, the alarm may send out frequencies which cannot be heard by humans. In such a scenario, the sound collection device/accelerometer may still be able to receive these frequencies and the frequencies will still cause a response in the sound collecting device/accelerometer.

In step 310, the environment is monitored for an aural or audible event. The environment is preferably continually monitored to provide comprehensive detection coverage even when no one person is around the alarm at the time.

In step 315, if an aural/audible or vibrational event is detected, the system moves to step 320. If no event is determined to have occurred then the system remains in step 310 until such an occurrence arises.

In step 320, a first signal is sent in response to an authentication by the system that an aural event has been detected. This first signal is sent from the alarm detection device to the wireless gateway. The aural event can be a number of events including an activation of an alarm, but may also include the alarm "chirp" that is sounded when an alarm is in need of a battery replacement. The notification as previously described would alert the user to a low battery situation. The notification may also alert the user to a low battery in the alarm detection device. Further, the LED (see FIG. 1) may alert any user present to the depleted battery present in the device.

In step 325, the wireless gateway receives and interprets the first signal and then sends a second signal in step 330 based on the type of signal received, as noted above, to tailor the notification display on the electronic device. This second signal is forwarded to at least one of a network based remote server, electronic page, or at least one of a plurality of users. This enables access to the signal from a number of electronic devices and further enables the information associated with the activation of an alarm to be logged and stored in a database from retrieval at a later date. In some embodiments, the first signal or the second signal is forward to the proper authorities.

In step 335, the user may take at least one action in response to the received notification on an electronic device. The response may be varied and can include silencing the alarm, alerting others to the presence of the activated alarm, contacting the authorities (i.e. fire/rescue/etc.) and the like. In some embodiments, the user may be able to communicate with the alarm detecting device via their electronic device to, for example, reset the alarm detecting device, change an operative state (on/off) of the alarm detecting device, etc.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A system for monitoring at least one remotely located alarm and alerting a remote location of a change in an operative state of the remotely located alarm, the system comprising:

at least one alarm capable of emitting at least one sound;

at least one alarm detection device consisting of:

a housing and is capable of being removably mounted within a proximity to the at least one alarm, and the alarm detection device having an accelerometer, a wireless transceiver, a sound collection device, and a processor, wherein authentication of the at least one sound emitted by the at least one alarm is configured to occur first via a vibratory analysis and be confirmed via an auditory analysis, wherein information for the vibratory analysis is collected via the accelerometer, and wherein information for the auditory analysis is collected via the sound collection device; and at least one wireless gateway operably coupled to the wireless transceiver, wherein the wireless gateway receives at least one first signal from the wireless transceiver and transmits at least one second signal to at least one of a network based remote server, electronic page, or at least one of a plurality of users, wherein the at least one second signal is transmitted on a scheduled or unscheduled basis, wherein whether the at least one second signal is scheduled or unscheduled is determined by the authentication of the at least one sound emitted by the at least one alarm, wherein if the at least one second signal is transmitted on an unscheduled basis then an active alarm is detected, and wherein if the at least one second signal is transmitted on a scheduled basis then a status report is transmitted concerning an operative state of the alarm detection device.

2. The system of claim 1 wherein the at least one alarm is an alarm associated with a security system, a fire detection system, a hazardous substance system, or any combination thereof.

3. The system of claim 1 wherein the at least one alarm detection device is located within about one meter from the at least one alarm.

4. The system of claim 1 wherein at least one of the plurality of users receives the at least one second signal from the wireless gateway.

5. The system of claim 4 wherein the at least one second signal identifies the at least one alarm, an operative indicator, or a date and a time or any combination thereof.

6. The system of claim 1 wherein the accelerometer is a digital accelerometer operating on at least three axis.

7. The system of claim 1 wherein the accelerometer registers angular rotation of the alarm detection device.

8. A system for alerting a remote location of a change in an operative state of an alarm, the system comprising:

one or more alarms capable of emitting at least one sound, wherein each of the one or more alarms may be the same or different as any of the other alarms;

an alarm detection device located within a proximity to each different type of alarm in the system, the alarm detection device consisting of: a housing with a sound collection port, the alarm detection device is capable of being removably mounted within a proximity to the one or more alarms with the sound collection port being oriented in a direction of the one or more alarms, and wherein the alarm detection device has an accelerometer, a temperature sensor, a wireless transceiver, a power source, a sound collection device, and a processor each contained within the housing, wherein authentication of the at least one sound emitted by the at least one alarm is configured to occur via a vibratory analysis and an auditory analysis, wherein information for the vibratory analysis is collected via the accelerometer, and wherein information for the auditory analysis is collected via the sound collection device; and at least one wireless gateway operably coupled to the wireless transceiver, wherein the wireless gateway receives a first signal from the wireless transceiver and transmits a second signal to at least one of a network based remote server, electronic page, or at least one of a plurality of users, and wherein the first signal and the second signal contain information related to the one or more alarms, wherein the second signal is transmitted on a scheduled or unscheduled basis, wherein whether the at least one second signal is scheduled or unscheduled is determined by the authentication of the at least one sound emitted by the at least one alarm, wherein if the at least one second signal is transmitted on an unscheduled basis then an active alarm is detected, and wherein if the at least one second signal is transmitted on a scheduled basis then a status report is transmitted concerning an operative state of the alarm detection device.

9. The system of claim 8 wherein the information contained within the first signal and the second signal is stored in a cloud storage platform.

10. The system of claim 8 wherein the at least one of a plurality of users may communicate with the system from an electronic device.

11. The system of claim 8 wherein the processor is programmed to filter the vibrations to eliminate the vibrations not associated with the one or more alarms.

12. The system of claim 8 wherein the processor analyzes the at least one sound to determine whether the wireless transceiver should send the first signal.

13. The system of claim 8 wherein the alarm detection device is capable of detecting and responding to a peak decibel level, wherein the peak decibel level is a reconfigurable decibel level threshold.

14. A method of remotely detecting a change in an operative state of at least one alarm, the method comprising the steps of:

securing the at least one alarm detection device of claim 8 within a proximity to the at least one alarm;

the at least one alarm detection device continually monitoring an environment for an aural event, wherein if an aural event is registered then the alarm detection device analyzes the aural event to determine its origin based on physical proximity to the at least one alarm;

the at least one alarm detection device sending a first signal upon an authentication of an origin of the aural event, wherein the authentication occurs via a vibratory analysis and an auditory analysis, wherein information for the vibratory analysis is collected via an accelerometer, and wherein information for the auditory analysis is collected via a sound collection device, wherein the auditory analysis includes a decibel level threshold which must be met in order for the first signal to be sent;

a wireless gateway receiving and interpreting the first signal, wherein the wireless gateway logs a date and time of the signal, the at least one alarm corresponding to the aural event, and the operative state of the at least one alarm; and the wireless gateway sending a second signal to at least one of a remote server or at least one user, wherein the at least one user receives an audio, visual, or audiovisual alert on an electronic device that identifies the at least one alarm.

15. The method of claim 14 further comprising the step of:

the at least one user taking at least one action in response to the audio, visual, or audiovisual alert.

16. The method of claim 14 wherein the alarm detection device receives and interprets sound waves that are analyzed for their tonal properties for indications of an aural event.

17. The method of claim 16 wherein the aural event is the activation of a smoke detector, carbon monoxide or other hazardous substance detector, or a security system.

18. The method of claim 16 wherein the tonal properties of the sound waves indicate a particular type of a triggered alarm of the at least one alarm.

* * * * *